US005380218A

United States Patent [19]

Yamamoto et al.

[11] Patent Number: 5,380,218

[45] Date of Patent: Jan. 10, 1995

[54] PRESSURE-CONTACT TERMINAL STRUCTURE

[75] Inventors: Hiroshi Yamamoto; Hitoshi Sakai, both of Shizuoka, Japan

[73] Assignee: Yazaki Corporation, Tokyo, Japan

[21] Appl. No.: 116,520

[22] Filed: Sep. 7, 1993

[30] Foreign Application Priority Data

Sep. 11, 1992 [JP] Japan ..... 4-243123

[51] Int. Cl.[6] ..... H01R 4/24

[52] U.S. Cl. ..... 439/397; 439/395

[58] Field of Search ..... 439/395, 397, 399, 400, 439/401

[56] References Cited

U.S. PATENT DOCUMENTS

| | | | |
|---|---|---|---|
| Re. 31,132 | 1/1983 | Hoppe, Jr. . | |
| 3,867,005 | 2/1975 | Hoppe, Jr. . | |
| 3,926,498 | 12/1975 | Hoppe, Jr. . | |
| 4,125,311 | 11/1978 | Hoppe, Jr. . | |
| 4,948,382 | 8/1990 | Marpoe, Jr. et al | 439/397 |
| 5,030,143 | 7/1991 | Hatagishi | 439/397 |
| 5,133,672 | 7/1992 | Nelligan, Jr. et al. | 439/397 |
| 5,282,758 | 2/1994 | Onoue | 439/395 |

FOREIGN PATENT DOCUMENTS

| | | |
|---|---|---|
| 49-132590 | 12/1974 | Japan . |
| 60-142463 | 9/1985 | Japan . |

*Primary Examiner*—Daniel W. Howell

*Attorney, Agent, or Firm*—Finnegan, Henderson, Farabow, Garrett & Dunner

[57] ABSTRACT

The terminal lug consists of an electrical contact portion and a wire connecting portion. In the wire connecting portion, the side plate portions on both sides of the base portion are bent upright. Between the side plate portions, plate-like pressing pieces each formed with a conductor contact slot are cut from the base portion and bent upright. The pressing pieces are each formed integrally with locking ears projecting from both sides of the rising base part thereof. The locking ears increase the width of the pressing piece and therefore strengthen the rising base part of the pressing piece where stresses concentrate. The locking ears are engaged in notches formed in the side plate portions to hold the pressing pieces reliably in their upright conditions.

7 Claims, 3 Drawing Sheets

PRESSURE-CONTACT TERMINAL STRUCTURE

BACKGROUND OF THE INVENTION

1. Field of the Invention

The present invention relates to a pressure-contact terminal structure used mainly for connecting automotive wiring harnesses.

2. Description of the Prior Art

Referring to FIG. 4 (Japanese Utility Model Preliminary Publication No. Showa 60-142463), a terminal lug a has an electrical contact portion $a_1$ and a wire connecting portion $a_2$. The wire connecting portion $a_2$ has plate-like pressing pieces b for holding a stripped conductor $w_1$ (FIG. 5) of the wire w and a crimping piece c for holding an insulation $w_2$ of the wire w. The plate-like pressing pieces b are formed by cutting the bottom plate portion d and bending the cut portions upright. The pressing pieces b are formed with a conductor contact slot $b_1$ at the center and also provided at the upper portion on each side with ears $b_2$, which are engaged in notches $e_1$ formed in the side plate portions e to prevent the pressing piece b from falling when the wire w is pressed into the conductor contact slot $b_1$.

With this construction, since the plate-like pressing pieces b are cut and raised from the bottom plate portion d, the width of the bent portions of the pressing pieces b is reduced by the thicknesses of the side plate portions e. For terminals of smaller sizes, this width reduction may result in the pressing pieces b being unable to withstand the load applied during the wire fitting work and therefore deformed.

To cope with this problem, it has been proposed that as shown in FIG. 6 (Japanese Patent Preliminary Publication No. Showa 49-132590), the plate-like pressing piece b' with the conductor contact slot $b_1'$ be formed by bending the side plate portion e' in the wire connecting portion $a_2'$ to make the width of the pressing piece b' and therefore its strength as large as possible. This method, however, requires high precision in bending the side plate portion because low bending accuracy would cause variations in the center position of the conductor contact slot $b_1'$ and hence makes the wire-fitting work by an automated machine difficult.

SUMMARY OF THE INVENTION

The object of this invention is to provide a pressure-contact terminal structure with a strengthened plate-like pressing piece which is held stable in the erected attitude.

To achieve the above objective, the pressure-contact terminal structure of this invention comprises:

an electrical contact portion; and a wire connecting portion, the wire connecting portion further comprising:

a base portion;

side plate portions formed on both sides of the base portion and bent upright;

at least one plate-like pressing piece cut and raised upright from the base portion and situated between the side plate portions, the pressing piece having a conductor contact slot; and locking ears integrally projecting from both sides of the lower part of the upright pressing piece, the locking ears being engaged in notches formed in the side plate portions.

With the ears engaged in the notches formed in the side plate portions, the plate-like pressing piece can be maintained in the erected attitude.

DETAILED DESCRIPTION OF PREFERRED EMBODIMENT

Figure 1:
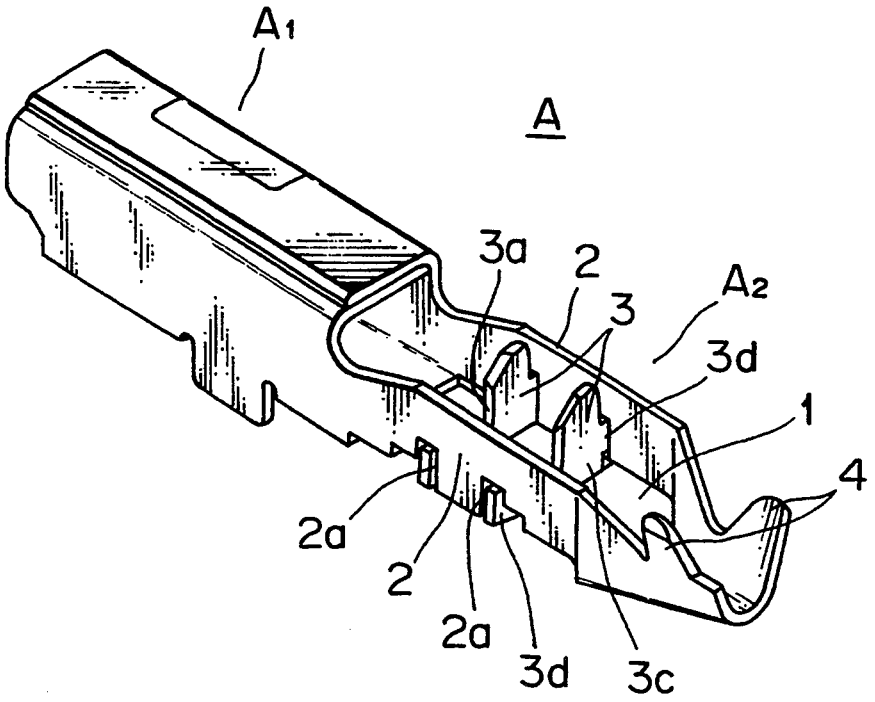
FIG. 1 is a perspective view of one embodiment of this invention.
Figure 2:
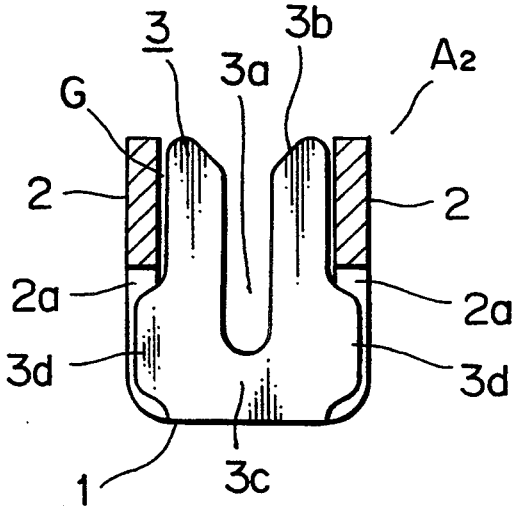
FIG. 2 is a cross section of an essential part of FIG. 1.

Referring to FIG. 1, the pressure-contact terminal lug A includes a female electrical contact portion $A_1$ and a wire connecting portion $A_2$ and is formed as a single-piece structure punched out from a metal sheet and bent into a desired shape.

referring the wire connecting portion $A_2$, the base portion 1 has its side plate portions 2 bent upright on both sides, between which two plate-like pressing pieces 3 for wire conductor that are cut from the base portion 1 are bent upright. As clearly shown in FIG. 2, the plate-like pressing piece 3 is formed with a conductor contact slot **3*a* at the center that extends downward from tapered blade portions 3*b* at the top. The pressing piece 3 also has locking ears 3*d* formed at a rising base part 3*c* on both sides extending from the bottom to the intermediate part of the slot 3*a*. The locking ears 3*d* are engaged in notches 2*a* cut in the lower part of the side plate portions 2. There is a gap G between the plate-like pressing piece 3 and the side plate portions 2 to allow for their deflections. At the rear of the wire connecting portion $A_2$ are provided crimping pieces 4** that hold the wire insulation.

Figure 3:
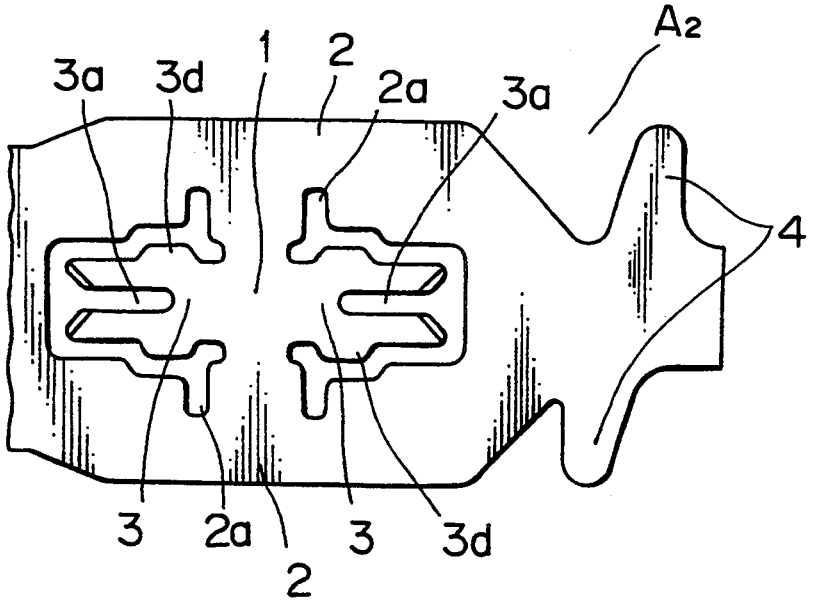
FIG. 3 is a developed view of an essential part of FIG. 1.
Figure 4:
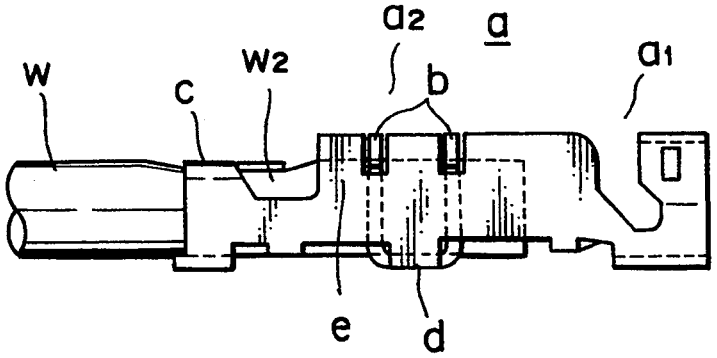
FIG. 4 PRIOR ART
FIG. 4 is a side view of a conventional terminal.
Figure 5:
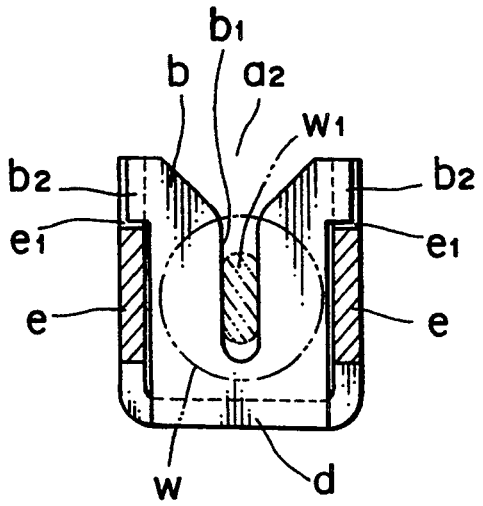
FIG. 5 PRIOR ART
FIG. 5 is a cross section of an essential part of FIG. 4.
Figure 6:
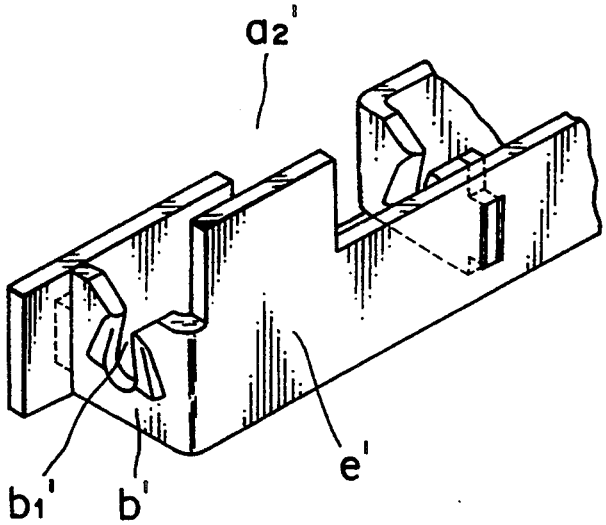
FIG. 6 PRIOR ART
FIG. 6 is a perspective view of another conventional terminal.

FIG. 3 shows a development view of the wire connecting portion $A_2$ punched out from a plate material. The pressing pieces 3 are first erected, followed by the side plate portions 2 being bent upright and then the engagement ears **3*d* being fitted into the notches 2*a***.

In the above construction, as a covered wire is pressed into conductor contact slots **3*a* formed in the plate-like pressing pieces 3, the insulation of the wire is cut by the tapered blade portions 3*b* and the bare conductor of the wire is fitted under pressure into the conductor contact slots 3*a* making electrical contact with the pressing pieces 3. The provision of the locking ears 3*d* at the rising base part 3*c* on both sides of the conductor contact slot 3*a* increases the width of the rising base part 3*c* where stresses concentrate and thus reinforces it. Hence, the pressing pieces 3 have sufficient strength to withstand forces applied during the wire fitting work. The locking ears 3*d* maintain the pressing pieces 3** in a stable erected condition.

As mentioned above, the terminal lug of this invention includes the electrical contact portion and the wire connecting portion. In the wire connecting portion, the base portion has its side plate portions bent upright on both sides, between which a plate-like pressing piece for wire conductor that is cut from the base portion is bent upright. The locking ears projecting from both sides of the rising base part of the pressing piece are engaged in the notches formed in the side plate portions. This construction provides the plate-like pressing piece with sufficient strength and reliably holds it in the stable upright attitude.

What is claimed is:

1. A pressure-contact terminal structure comprising: an electrical contact portion; and a wire connecting portion, the wire connecting portion further comprising:

a base portion;

side plate portions formed on both sides of the base portion and bent upright:

at least one plate-like pressing piece cut and raised upright from the base portion and situated between the side plate portions, the pressing piece having a conductor contact slot: and locking ears integrally projecting from both sides of the lower part of the upright pressing piece, the locking ears being engaged in notches formed in the side plate portions.

2. A pressure-contact terminal structure according to claim 1, wherein two of the pressing piece are provided one behind the other in the longitudinal direction of the wire connecting portion.

3. A pressure-contact terminal structure according to claim 1, wherein the conductor contact slot extends downwardly at the center from the top of the pressing piece.

4. A pressure-contact terminal structure according to claim 3, wherein the conductor contact slot extends downwardly via tapered blade portions formed at the top of the pressing piece on both sides of the slot.

5. A pressure-contact terminal structure according to claim 1, wherein the wire connecting portion further comprises a gap between the pressing piece and the side plate portions to allow for deflections of the pressing piece.

6. A pressure-contact terminal structure according to claim 1, wherein the projected locking ears on both sides of the lower part of the upright pressing piece extend to a height intermediate the slot.

7. A pressure-contact terminal structure according to claim 1, wherein the wire connecting portion is formed from a one-piece metal.

* * * * *